United States Patent [19]

Nishikawa

[11] Patent Number: 4,987,871

[45] Date of Patent: Jan. 29, 1991

[54] OPERATION CONTROL SYSTEM FOR INTERNAL COMBUSTION ENGINES AT AND AFTER STARTING

[75] Inventor: Takafumi Nishikawa, Wako, Japan

[73] Assignee: Honda Giken Kogyo K.K., Tokyo, Japan

[21] Appl. No.: 306,825

[22] Filed: Feb. 3, 1989

[30] Foreign Application Priority Data

Feb. 7, 1988 [JP] Japan ..... 63-25934

[51] Int. Cl.[5] ..... F02D 41/06

[52] U.S. Cl. ..... 123/362; 123/179 G; 123/491; 123/588

[58] Field of Search ..... 123/362, 179 A, 179 G, 123/179 L, 588, 491

[56] References Cited

U.S. PATENT DOCUMENTS

| | | | |
|---|---|---|---|
| 3,749,070 | 7/1973 | Oishi et al. | 123/491 |
| 3,960,130 | 6/1976 | Peterson, Jr. | 123/179 A |
| 4,414,943 | 11/1983 | Nagase | 123/588 |
| 4,463,723 | 8/1984 | Tansuwan | 123/179 G |
| 4,548,178 | 10/1985 | Sato et al. | 123/491 |

FOREIGN PATENT DOCUMENTS

| | | | |
|---|---|---|---|
| 59-32648 | 2/1984 | Japan | 123/179 G |

*Primary Examiner*—Andrew M. Dolinar
*Attorney, Agent, or Firm*—Arthur L. Lessler

[57] ABSTRACT

An operation control system for internal combustion engines at and after starting has an engine temperature sensor, a control valve for controlling the amount of intake air to be supplied to the engine, and a valve opening determining device responsive to an output from the engine temperature sensor for determining the opening of the control valve. The valve opening determining device sets the opening of the control valve at the start of the engine to a value such that the intake air amount is smaller as the engine temperature is lower. A fuel amount determining device is responsive to the output from the engine temperature sensor for determining the amount of fuel to be supplied to the engine at starting. A correction value determining device is responsive to the opening of a throttle valve of the engine for determining a correction value for the fuel amount in such a manner as to increase the fuel amount at a larger rate as the throttle opening is larger. A valve opening progressive increase device progressively increases the opening of the control valve after the start of the engine. A valve opening progressive decrease device progressively decreases the opening of same after the engine rotational speed reaches a predetermined value after the start of the engine.

26 Claims, 9 Drawing Sheets

OPERATION CONTROL SYSTEM FOR INTERNAL COMBUSTION ENGINES AT AND AFTER STARTING

BACKGROUND OF THE INVENTION

This invention relates to an operation control system for controlling the operation of internal combustion engines at and after starting, and more particularly to an operation control system of this kind, which is intended to enhance the startability of the engine of a high output type when the engine temperature is low at and after the start of the engine.

Conventional starting control systems for internal combustion engines are generally constructed such that at the start of the engine, the opening of an intake air amount control valve is set to a value dependent on the engine temperature to obtain a required amount of intake air, and the amount of fuel is also set to a value dependent on the engine temperature, whereby a predetermined air-fuel mixture is supplied to the engine.

According to the conventional starting control systems, the opening of the control valve is set to a larger value as the engine temperature is lower, which however, causes degraded startability of engines of some types. More specifically, there are some engines which have fuel injection systems, and which have their intake valves, exhaust valves and throttle valves enlarged in diameter to increase the engine output in order to meet the recent demand for more versatile vehicles.

In an engine with such enlarged intake valves, exhaust valves and throttle valves, intake air flow in the intake pipe is slow in speed, which causes degraded atomization of fuel. Especially when the engine temperature is low, as described above, the intake air amount control valve is set to a large opening, so that vacuum created within the intake pipe becomes lower, resulting in further degraded atomization of fuel. Further, in a low intake air flow region such as at the start of the engine, the valve-overlapping period when the intake and exhaust valves are simultaneously open is so long that a large amount of intake air drawn into the cylinder is discharged into the exhaust pipe through the exhaust valve directly from the intake valve. Therefore, the startability is further degraded.

Moreover, if a vacuum-responsive type ignition timing control device is employed in combination with the above described starting control system in which the opening of the control valve is set to a larger value as the engine temperature is lower, it is difficult to properly control the ignition timing, since vacuum sufficient to achieve proper ignition timing control cannot be created especially when the engine temperature is low, thus being unable to meet the requirement that the ignition timing should be advanced by a larger amount as the engine temperature is lower. This also forms a factor for degraded startability of the engine.

SUMMARY OF THE INVENTION

It is an object of the invention to provide a control system for controlling the operation of an internal combustion engine at the start thereof, which is capable of creating high vacuum in the intake pipe even when the engine temperature is low, thereby promoting the atomization of fuel at the start of the engine and hence enhancing the startability of the engine, even if the engine is of a high output type.

It is a further object of the invention to ensure positive advance of the ignition timing to thereby enhance the startability of the engine, if the engine is equipped with a vacuum-responsive type ignition timing control device.

It is another object of the invention to effect fuel supply control at the start of the engine in a manner particularly suitable for the intake air amount control at the start of same, thereby enhancing the startability of same.

It is still another object of the invention to effect positive firing of the engine even if the accelerator pedal is stepped on in order to start the engine, thereby enhancing the startability of the engine.

It is a further object of the invention to ensure supply of an air-fuel mixture at a proper air-fuel ratio even when the starting period is long, thereby effect positive firing of the engine.

It is another object of the invention to preventing engine stalling due to degraded atomization of fuel or failure to obtain advance of the ignition timing, which are liable to take place when the intake air amount is abruptly increased after the start of the engine, to thereby smoothly increase the engine rotational speed, and at the same time increase engine torque in a stable manner so as to cope with an increase in the viscosity of engine lubricating oil due to low engine temperature, and quickly warm up the engine also in a stable manner.

It is another object of the invention to prevent vacuum created within the intake pipe from being lowered, which would be caused by due to an excessive increase in the intake air amount supplied into the intake pipe after the start of the engine, thereby enhancing the stability of the engine rotational speed.

It is a further object of the invention to enable to smoothly shift the after-starting control to idling feedback control of the engine rotational speed.

According to the invention, there is provided a system for controlling the operation of an internal combustion engine having an intake passage, including temperature sensor means for sensing a temperature of the engine, control valve means for controlling an amount of intake air supplied into the intake passage of the engine, valve opening determining means responsive to an output from the temperature sensor means for determining the opening of the control valve means at the start of the engine, and valve actuator means responsive to an output from the valve opening determining means for controlling the control valve means.

The system is characterized by an improvement wherein the valve opening determining means sets the opening of the control valve at the start of the engine to a value such that the amount of intake air is smaller as the temperature of the engine sensed by the temperature sensor means is lower.

Preferably, the engine has a throttle valve arranged in the intake passage, and the system includes fuel amount determining means responsive to the output from the temperature sensor means for determining an amount of fuel to be supplied to the engine at the start of same, fuel supply means for supplying the engine with the amount of fuel determined by the fuel amount determining means, second valve opening sensor means for sensing the opening of the throttle valve, correction value determining means responsive to an output from the second valve opening sensor means for determining a correction value for the amount of fuel, the correction value determining means determining the correction value so as to increase the amount of fuel at a larger rate as the opening of the throttle valve is larger, and correcting means for correcting the amount of fuel based on the determined correction value.

More preferably, the system includes starting period detecting means for detecting whether or not a starting state of the engine has lasted over a predetermined period of time, and intake air amount correcting means for correcting the amount of intake air to a larger value after the predetermined period of time has elapsed.

The predetermined period of time is set to a shorter value as the temperature of the engine is lower.

Further preferably, the system includes third valve opening determining means responsive to the output from the temperature sensor means for determining the opening of the control valve after the start of the engine, upper limit value setting means responsive to the output from the temperature sensor means for setting an upper limit value of the opening of the control valve after the start of the engine, and valve opening progressive increase means for progressively increasing the opening of the control valve determined by the third valve opening determining means to the set upper limit value.

The third valve opening determining means sets the opening of the control valve to a smaller value as the temperature of the engine is lower.

The upper limit value of the opening of the control valve is set to a larger value as the temperature of the engine is lower.

The valve opening progressive increase means progressively increases the opening of the control valve at a smaller rate as the temperature of the engine is lower.

Preferably, the system includes engine rotational speed setting means responsive to the output from the temperature sensor means for setting a predetermined value of the rotational speed of the engine, and valve opening progressive decrease means for progressively decreasing the opening of the control valve after the rotational speed of the engine reaches the predetermined value.

The engine rotational speed setting means sets the predetermined value to a larger value as the temperature of the engine is lower.

The valve opening progressive decrease means progressively decreases the opening of the control valve at a smaller rate as the temperature of the engine is lower.

Preferably, the system includes progressive increase stop means for stopping the progressive increase of the opening of the control valve effected by the valve opening progressive increase means when the rotational speed of the engine reaches the predetermined value.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
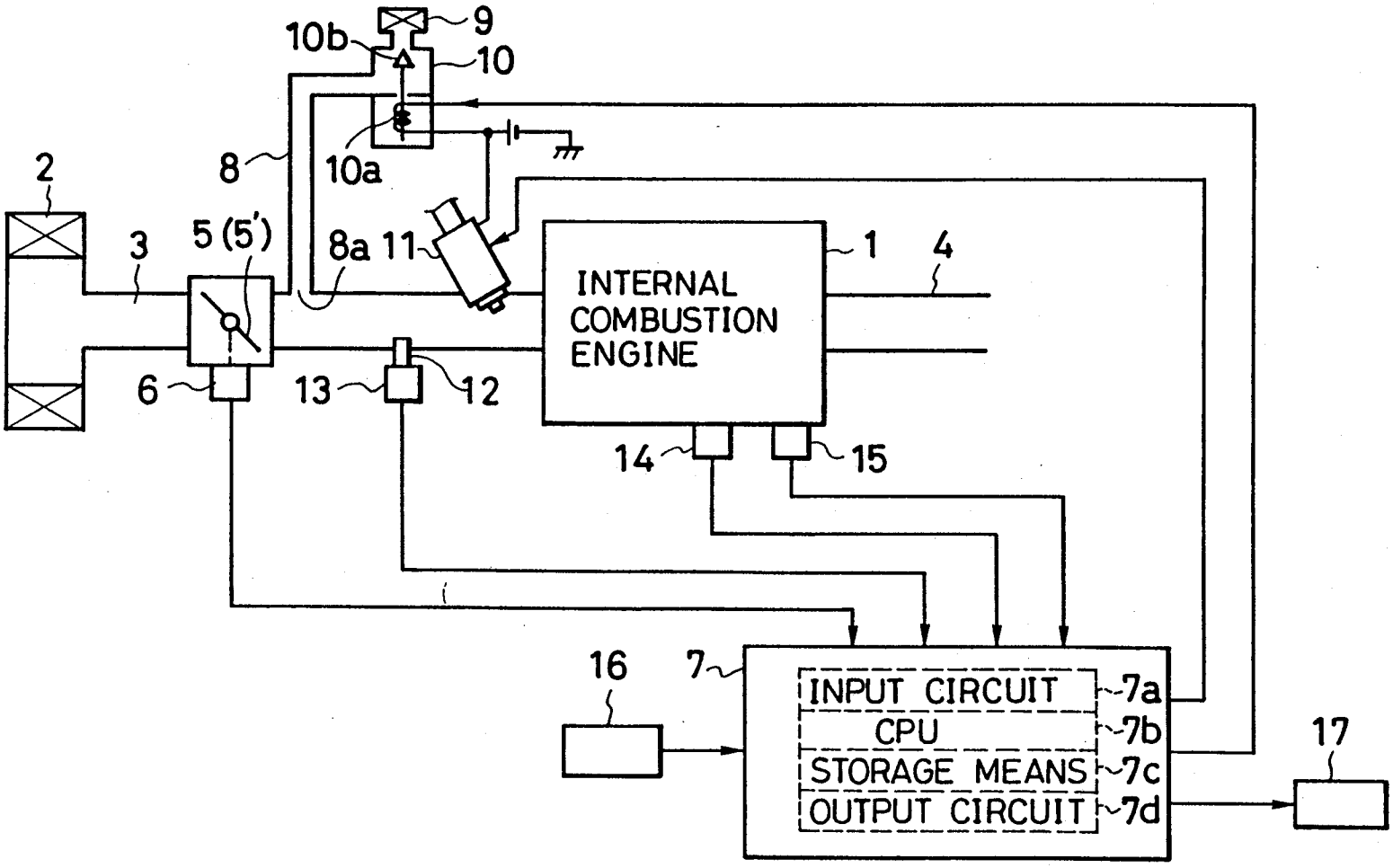
FIG. 1 is a block diagram illustrating the whole arrangement of an operation control system for an internal combustion engine, according to the invention.

Referring first to FIG. 1, there is schematically illustrated a control system for controlling the operation of an internal combustion engine, according to the invention. In FIG. 1, reference numeral 1 designates an internal combustion engine which may be a four-cylinder type for instance, and to which are connected an intake pipe 3 with an air cleaner 2 mounted at its open end, and an exhaust pipe 4, at an intake side and an exhaust side of the engine 1, respectively. A throttle body 5 is arranged across the intake pipe 3, within which a throttle valve 5' is arranged. A throttle opening ($\theta_{TH}$) sensor 6 is connected to the throttle valve 5' for sensing its valve opening and is electrically connected to an electronic control unit (hereinafter called "the ECU") 7, to supply same with an electrical signal indicative of the throttle valve opening sensed thereby.

An air passage 8 opens at its one end 8*a* into the intake pipe 3 at a location downstream of the throttle valve 5'. The air passage 8 has its other end communicating with the atmosphere and provided with an air cleaner 9. An auxiliary air amount control valve (hereinafter called merely "the control valve") 10 is arranged across the air passage 8 to control the quantity of auxiliary air to be supplied to the engine 1 through the air passage 8. This control valve 10 is a normally closed type solenoid valve, and comprises a solenoid 10*a*, and a valve body 10*b* disposed to open the air passage 8 when the solenoid 10*a* is energized. The solenoid 10*a* is electrically connected to the ECU 7.

Fuel injection valves 6 are arranged in the intake pipe 3 between the engine 1 and the one end 8*a* of the air passage 8, each being located slightly upstream of an intake valve, not shown, of a corresponding one of the engine cylinders, and connected to a fuel pump, not shower.

The intake valves and exhaust valves, not shown, of the engine have larger bores than those of ordinary types, and also the throttle valve 5' has a larger maximum opening than that of an ordinary type, in order to obtain increased output of the engine 1.

The fuel injection valves 11 are electrically connected to the ECU 7, to have their valve opening periods or fuel injection quantities controlled by driving signals supplied from the ECU 7.

An absolute pressure sensor ($P_{BA}$) 13 is provided in communication with the intake pipe 3 through a conduit 12 at a location downstream of the open end 8*a* of the air passage 8. The absolute pressure sensor 13 is electrically connected to the ECU 7 to apply an electrical output signal indicative of the sensed absolute pressure to the ECU 7.

An engine coolant temperature ($T_W$) sensor 14, which may be formed of a thermistor or the like, is mounted in an engine cylinder, not shown, of the engine 1 in a manner being embedded in the peripheral wall of the engine cylinder having its interior filled with coolant, of which an electrical output signal indicative of the sensed coolant temperature is supplied to the ECU 7.

An engine rotational speed position ($N_e$) sensor 15 is arranged in facing relation to a camshaft of the engine 1 or a crankshaft of same, neither of which is shown. The Ne sensor 15 generates a pulse (hereinafter called "the TDC signal") at a predetermined crank angle position before a dead center at the start of suction stroke of each cylinder, whenever the engine crankshaft rotates through 180 degrees, and supplies the TDC signal to the ECU 7.

A starting switch 16 of the engine 1 is also connected to the ECU 7 and supplies same with an output signal indicative of on and off states of the starting switch 16. Further connected to the ECU 7 is a vacuum-responsive type ignition timing control device 17, which is responsive to vacuum within the intake pipe 3 for controlling the ignition timing of each cylinder of the engine 1 in response to a control signal from the ECU 7.

The ECU 7 comprises an input circuit *7a* having functions of shaping the waveforms of signals outputted from engine operating parameter sensors and the starting switch 16, shifting the voltage levels of these signals to a predetermined level, and subjecting the level-shifted signals to analog-to-digital conversion, a central processing unit *7b* (hereinafter called "the CPU"), storage means *7c* storing control programs to be executed by the CPU *7b* and for storing results of calculations executed by the CPU *7b*, and an output circuit *7d* for supplying driving signals to the fuel injection valves 11 and the control valve 10 and also supplying the control signal to the ignition timing control device 17.

The storage means *7c* stores a cranking-discriminating subroutine, and control programs, maps, and tables to be used in controlling the engine operation in starting mode and after-starting mode.

The CPU *7b* operates in response to various engine operating parameter signals outputted from engine operating parameter sensors such as the throttle opening sensor 6, the absolute pressure sensor 13, the engine coolant temperature sensor 14, and the engine rotational speed sensor 15, as well as the an on/off state signal outputted from the starting switch 16, to determine operating conditions of the engine 1 based upon the supplied signals, calculate a fuel amount to be supplied to the engine 1, i.e. a fuel injection period $T_{OUT}$ of each of the fuel injection valves 11, and an auxiliary air amount, i.e. a control output value for controlling the solenoid 10*a* of the solenoid valve 10, and supply driving signals for driving the fuel injection valves 11, the control valve 10 and the vacuum-responsive type ignition timing control device 17 via the output circuit *7d*. As the control output value for controlling the solenoid 10*a*, an amount of solenoid driving current (valve opening command value $I_{CMD}$) is calculated since in the embodiment the solenoid 10*a* is a linear type, which varies the opening of the valve body 10*b* in proportion to an amount of current applied thereto.

The solenoid 10*a* of the control valve 10 is energized by the solenoid driving current to open the control valve 10, i.e. the air passage 8, to a degree corresponding to the value of the solenoid driving current so that a required amount of auxiliary air, which corresponds to the opening degree of the control valve 10, is supplied to the engine 1 through the air passage 8 and the intake pipe 3.

The fuel injection valves 11 are each opened over the calculated fuel injection period to inject fuel into the intake pipe 3, and then the fuel is mixed with intake air into a required air/fuel mixture to be supplied to the engine 1.

When the opening of the control valve 10 is increased to thereby increase the amount of auxiliary air, an increased amount of mixture is supplied to the engine 1 so that the engine output and hence the engine rotational speed is increased accordingly. Conversely, when the opening of the control valve 10 is decreased, a decreased amount of mixture is supplied to thereby decrease the engine rotational speed. Thus, the engine output or the engine rotational speed is controlled by controlling the auxiliary air amount or the opening of the control valve 10.

During idling feedback control of the engine 1 in after-starting mode following the engine start, PID control (proportional, integral and differential control) may be employed by calculating a value $I_{NOBJ}$ of the valve opening command value $I_{CMD}$ by the use of the following equation (1):

$$I_{NOBJ}=K_P\times\Delta N+K_i\times I_{in}+K_D\times\Delta N_e \quad (1)$$

where ($K_P\times\Delta N$) represents the proportional control term (P-term) which is obtained by multiplying the difference $\Delta N$ between a desired idling rotational speed $N_{OBJ}$ and the actual engine rotational speed $N_e$ by a proportional control gain $K_P$. The integral control term (I-term) is obtained by multiplying an integral control value $I_{in}$, which is obtained by the use of the following equation (2), by an integral control gain $K_i$:

$$I_{in}+K_i\times\Delta N+I_{in-1} \quad (2)$$

In the equation (1), ($K_D\times\Delta N_e$) represents the differential control term (D-term) which is obtained by multiplying the difference $\Delta N_e$ between a value $N_{en}$ of the engine rotational speed in the present loop and a value $N_{en-1}$ of same in the last loop by a differential control gain $K_D$.

During the idling feedback control of the engine 1, the amount of intake air is controlled based upon the equation (1), and at the same time the amount of fuel to be supplied to the engine 1 is controlled by executing a basic control program, hereinafter described. On the other hand, during cranking or starting mode of the engine 1, the following control is effected.

Figure 2:
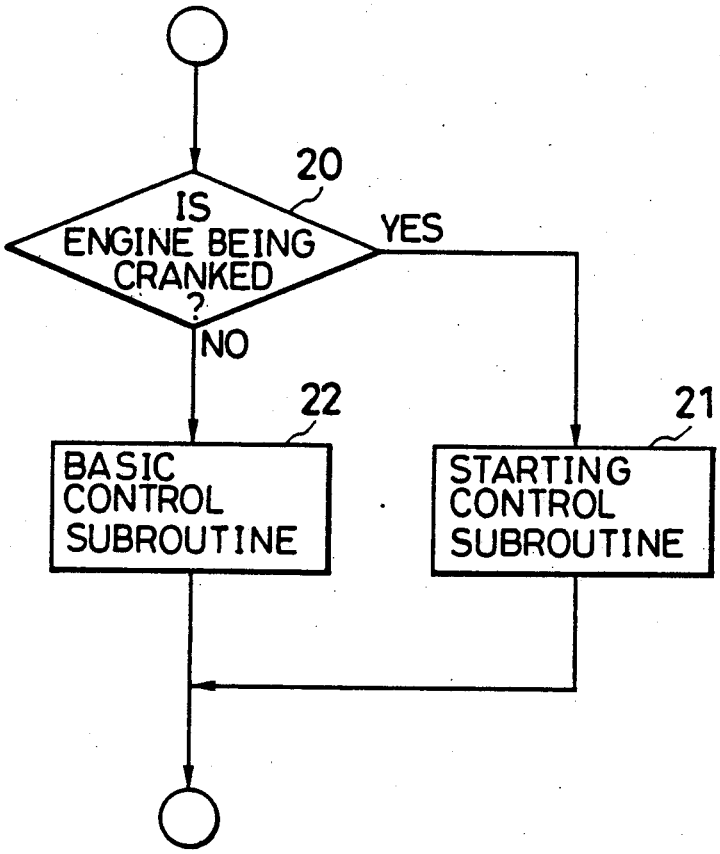
FIG. 2 is a flowchart showing a subroutine for determining a cranking state of the engine.

FIG. 2 shows the cranking-discriminating subroutine. This subroutine is executed by the ECU 7 whenever a TDC signal pulse is inputted thereto.

At a step 20, it is determined whether or not the engine 1 is being cranked. If the answer to the question is Yes, a starting control subroutine is executed at a step 21, whereas if the answer is No, a basic control subroutine is executed at a step 22. Each of the subroutines is for calculating the valve opening command value $I_{NOBJ}$ for controlling the solenoid 10*a* of the control valve 10 and the fuel injection period $T_{OUT}$ of the fuel injection valves 11 responsive to engine operating conditions. The step 20 may be executed by determining whether or not the starting switch 16 is closed and at the same time the engine rotational speed $N_e$ is lower than a predetermined cranking-discriminating rotational speed $N_{CR}$ (e.g. 400 rpm).

Figure 3:
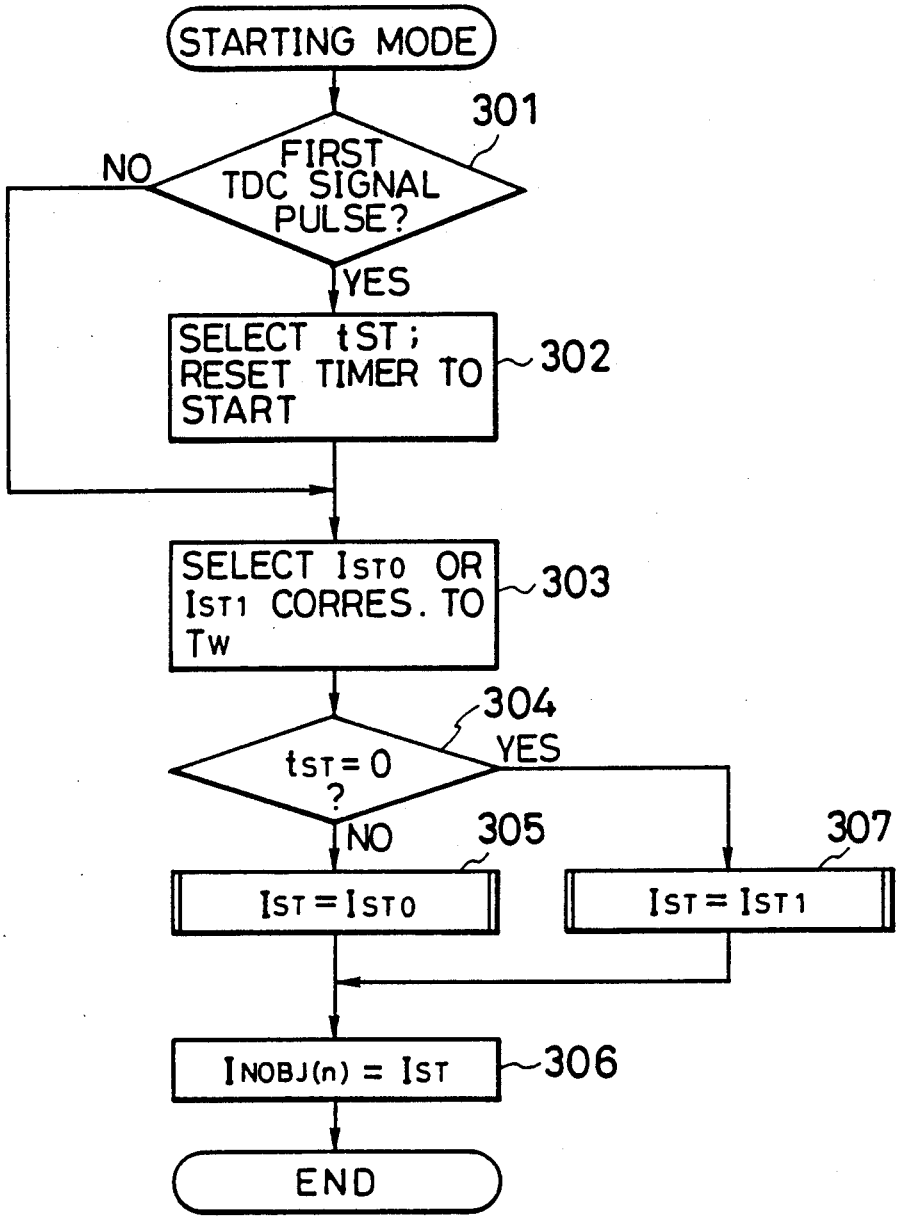
FIG. 3 is a flowchart showing a subroutine for calculating a control output or valve opening command value $I_{ST}$ applied at the start of the engine.

FIG. 3 shows the starting control subroutine for calculating the valve opening command value $I_{NOBJ}$.

Figure 4:
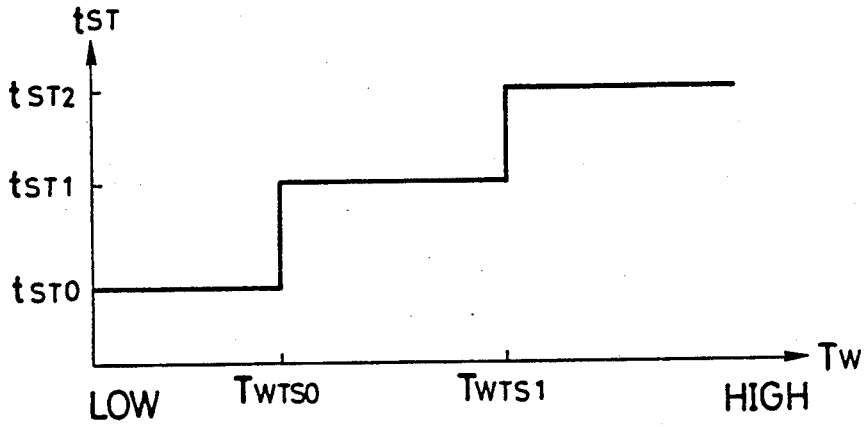
FIG. 4 is a graph showing an example of a $t_{ST}$ table.
Figure 12:
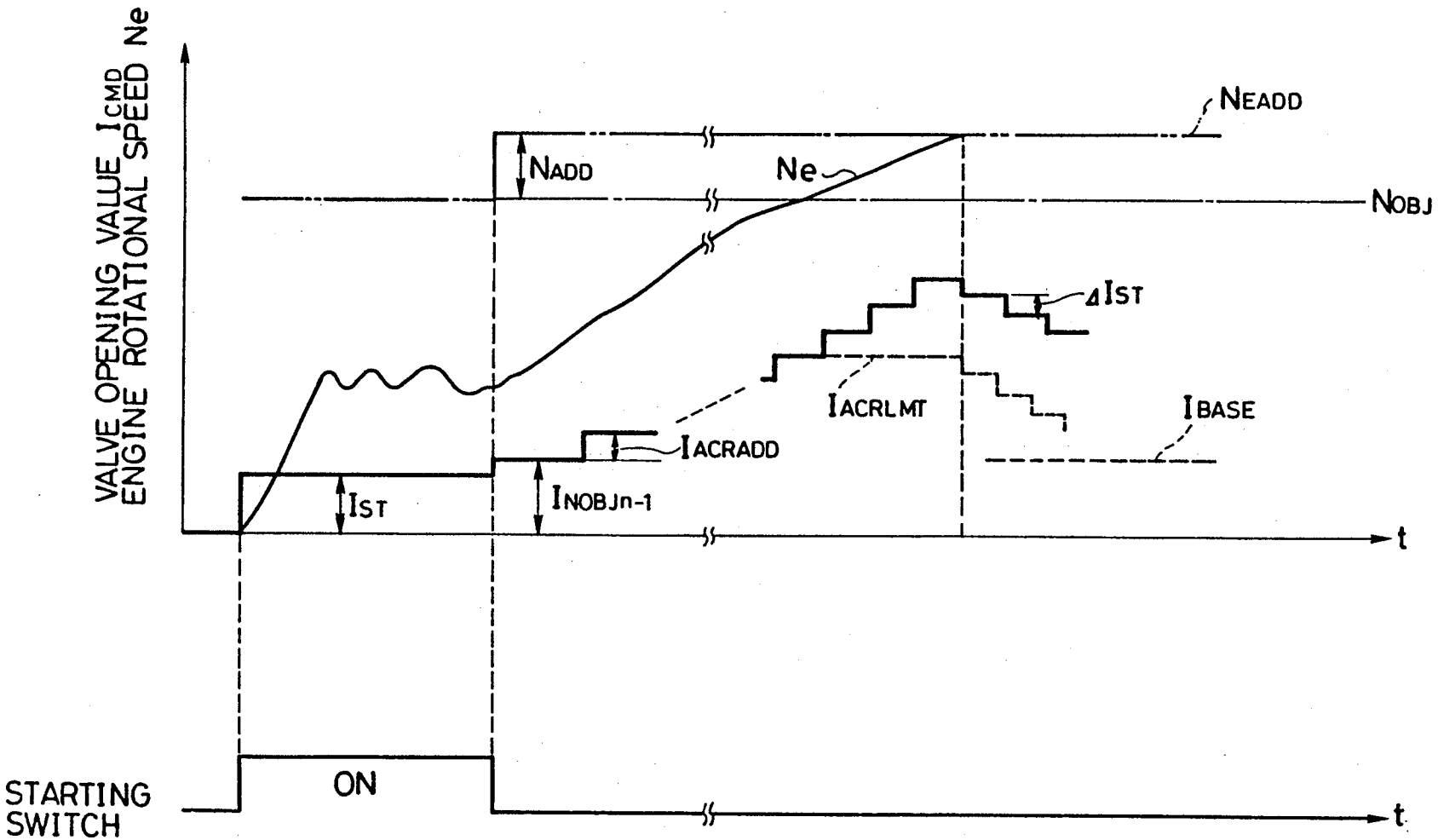
FIG. 12 is a timing chart useful in explaining the relationship between the engine rotational speed Ne and the valve opening command value $I_{CMD}$.

First, when the starting switch 16 is closed to bring the engine 1 into the starting mode, as shown in FIG. 12, it is determined at a step 301 whether or not a TDC signal pulse in the present loop is the first pulse. If the answer is Yes, that is, if it is the first pulse in the starting mode, a value $t_{ST}$ of a timer, which may be formed of a down counter, for counting the duration of the starting mode is selected in response to a value of the engine coolant temperature $T_W$, and then the timer is reset to start counting (at a step 302). The timer value $t_{ST}$ may be selected at the step 302 from a map shown in FIG. 4, wherein there are provided predetermined values $t_{ST0}-t_{ST2}$ in respective predetermined ranges of the engine coolant temperature $T_W$, i.e. $T_W \leqq T_{WTS0}$, $T_{WTS0}<T_W<T_{WTS1}$, $T_{WTS1} \leqq T_W$, in such a manner that a smaller value $t_{ST}$ is selected as the engine coolant temperature $T_W$ is lower.

Figure 5:
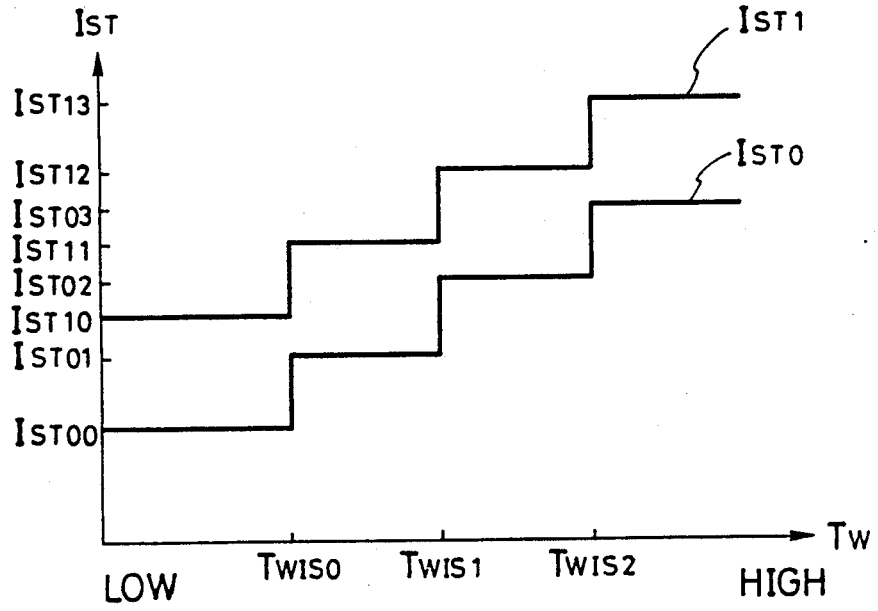
FIG. 5 is a graph showing an example of an $I_{ST}$ table.

Then, at a step 303, the valve opening command value $I_{ST}$ applied at the start of the engine 1 corresponding to the engine coolant temperature $T_W$ is searched by the use of an $I_{ST}$ table shown in FIG. 5. In the figure, an $I_{ST0}$ line to be normally used and an $I_{ST1}$ line greater than the $I_{ST0}$ line by a predetermined value for leaning the mixture, hereinafter described, are provided as the $I_{ST}$ line, both of which are set such that smaller valve opening command values $I_{ST}$ are selected as the engine coolant temperature $T_W$ is lower. More specifically, as the IST value there are provided predetermined values $I_{ST10}-I_{ST13}$ for respective predetermined ranges of the engine coolant temperature $T_W$, i.e. $T_W \leqq T_{WIS0}$, $T_{WIS0}<T_W<T_{WIS1}$, $T_{WIS1} \leqq T_W \leqq T_{WIS2}$, $T_{WIS2}<T_W$.

Incidentally, the $I_{ST0}$ line and the $I_{ST1}$ line may have their respective values varied e.g. in dependence upon whether a vehicle on which the engine 1 is installed is equipped with an automatic transmission or a manual transmission (the former requires higher engine output than the latter), to achieve more suitable starting control irrespective of the kind of the transmission of the vehicle.

After the value $I_{ST0}$ or $I_{ST1}$ is selected in dependence on the engine coolant temperature $T_W$ at the step 303, it is determined at a step 304 whether or not the timer value $t_{ST}$ is 0, that is, whether or not a predetermined time period set at the step 302 has elapsed after the timer was reset to start. In the present loop where the TDC signal pulse is the first pulse, the answer to the question should be No, since the value $t_{ST}$ is not yet 0 in the present loop. Then, a value on the $I_{ST0}$ line is selected, which corresponds to the engine coolant temperature $T_W$, as the valve opening command value $I_{ST}$ at a step 305, and at a step 306 the selected value $I_{ST}$ is then set as the output control value $I_{NOBJ}$ for controlling the control valve 10 in the present loop, followed by termination of the program.

In the next loop et seq., the answer to the question at the step 301 becomes No, so that the program skips over the step 302 to the step 303 et seq. If the timer value $t_{ST}$ is not 0 at the step 304, the program proceeds to the steps 305 and 306. As described above, during the starting mode of the engine 1, a valve opening command value $I_{ST}$ on the $I_{ST0}$ line in FIG. 5 is supplied as the control output value $I_{CMD}$, as shown in FIG. 12. Since the value $I_{ST}$ is set to a smaller value as the value $T_W$ decreases, the opening of the valve 10*b* (i.e. the amount of intake air) is decreased as the engine coolant temperature $T_W$ is lower during the starting mode, to thereby create higher vacuum within the intake pipe 3 and hence promote the atomization of fuel, as the engine coolant temperature $T_W$ is lower.

Therefore, even in an engine of a high output type, the atomization of fuel can be promoted to enhance the startability of the engine by creating sufficient vacuum, i.e. decreasing absolute pressure within the intake pipe 3.

Further, since higher vacuum is created, that is, the absolute pressure is decreased as the engine coolant temperature $T_W$ is lower, if ignition is controlled by the vacuum-responsive type ignition timing control device 17, the ignition timing can be advanced by a larger amount as the engine coolant temperature $T_W$ is lower.

That is, at the start of the engine 1, vacuum can be easily created by decreasing the opening of the control valve 10 as the coolant temperature $T_W$ is lower, so that the ignition timing of the ignition timing control device 17 can be smoothly advanced even when the engine coolant temperature $T_W$ is low, thereby enabling positive ignition or firing at the start of the engine 1 as well as obtaining proper ignition timing immediately after the start of firing to enhance the startability of the engine.

The fuel supply control in accordance with the starting control subroutine in FIG. 2 is effected in the following manner during cranking of the engine 1.

During cranking of the engine 1, the fuel injection period $T_{OUT}$ of the fuel injection valves 11 is calculated by the use of the following equation (3):

$$T_{OUT}=T_{iCR}\times K_{TiCR}+K \quad (3)$$

where $T_{iCR}$ represents a basic value of the valve opening period of the valve 11, which is determined from a $T_W$-$T_{iCR}$ table as a function of the engine coolant temperature $T_W$, $K_{TiCR}$ a starting fuel-increasing coefficient for increasing the fuel in response to the throttle valve opening $\theta_{TH}$ during cranking of the engine 1, which is determined from a $\theta_{TH}$-$K_{TiCR}$ table as a function of the throttle valve opening $\theta_{TH}$, and K ather correction variables including a variable for compensating for the battery voltage.

Since, as described above, at the start of the engine 1 in cold state, vacuum is created within the intake pipe 3 to supply a smaller amount of intake air to the engine 1 than a conventionally required amount, a correspondingly smaller amount of fuel is supplied to the engine 1 to cope with the smaller amount of intake air.

Figure 6:
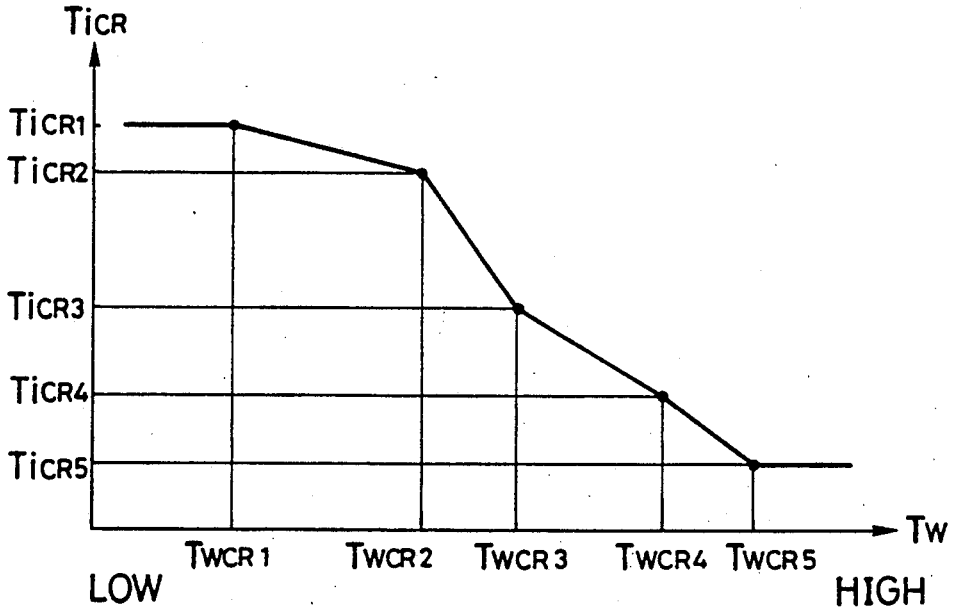
FIG. 6 is a graph showing an example of a $T_{ICR}$ table.

FIG. 6 shows a table showing the relationship between the engine coolant temperature $T_W$ and the basic value $T_{iCR}$ of the valve opening period of the fuel injection valves 11 applied at the start of the engine 1. The value $T_{iCR}$ is determined depending on the value $T_W$. In the figure, respective values $T_{iCR}$, i.e. $T_{iCR1}-T_{iCR5}$ (e.g. 116 ms, 88 ms, 46 ms, 31 ms, 21 ms), are provided, and correspond, respectively, to five predetermined values of the engine coolant temperature, i.e. $T_{WCR1}-T_{WCR5}$ (e.g. −20° C., −10° C., 10° C., 25° C., 50° C.) as calibration variables, in such a manner that a smaller value $T_{iCR}$ is selected as the coolant temperature $T_W$ is higher. When the actual engine coolant temperature $T_W$ falls between adjacent $T_{WCR}$ values, the value $T_{iCR}$ is calculated by interpolation.

Since the amount of intake air is decreased during the starting mode, as described above, the basic values $T_{iCR1}$–$T_{iCR5}$ are set at such values as to obtain fuel amounts required for the start of the engine 1 and commensurate with an air amount supplied to the engine with the throttle valve fully closed. That is, the basic values TiCR1–TiCR5 are set at such small values that the fuel supply amount calculated based upon the basic value $T_{iCR}$ is smaller than a conventional amount, when the engine coolant temperature $T_W$ is low. As a result, the mixture supplied to the engine 1 has an appropriate air-fuel ratio to the decreased intake air amount.

Figure 7:
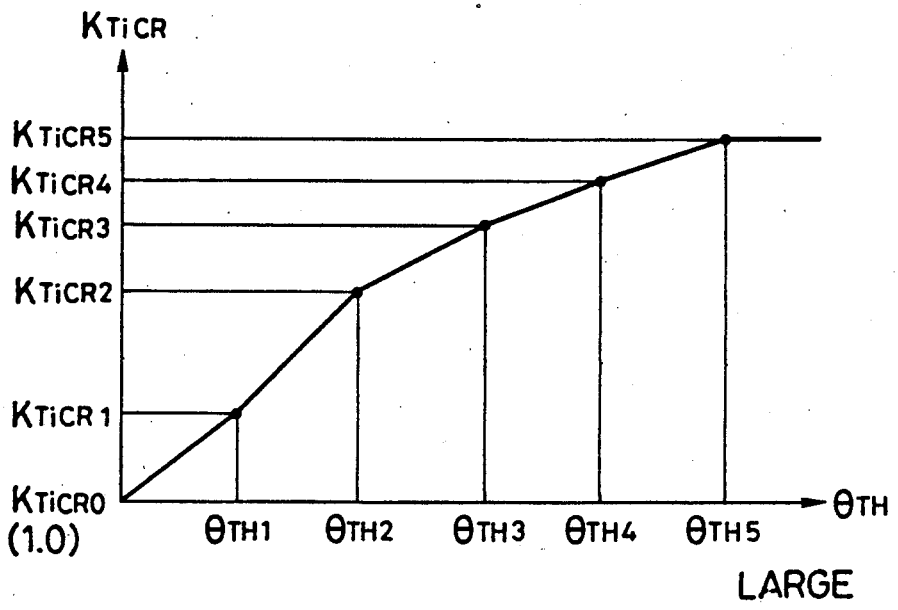
FIG. 7 is a graph showing an example of a $K_{TICR}$ table.

FIG. 7 shows a table showing the relationship between the throttle valve opening $\theta_{TH}$ and the fuel-increasing correction coefficient $K_{TiCR}$. In the table, predetermined values of the correction coefficient $K_{TiCR1}$–$K_{TiCR5}$ (e.g. if $K_{TiCR1}=1.0$, $K_{TiCR5}=1.5$), are provided as corresponding to respective five predetermined values of the throttle valve opening, i.e. $\theta_{TH1}$–$\theta_{TH5}$ ($\theta_{TH5}$ is e.g. 20°). When the throttle valve opening $\theta_{TH}$ falls between adjacent predetermined $\theta_{TH}$ values, the value $K_{TiCR}$ is calculated by interpolation.

$T_{OUT}$ is calculated by multiplying the basic value $T_{iCR}$ by the coefficient $K_{TiCR}$ determined depending on the value $\theta_{TH}$ from the $K_{TiCR}$ table. Thus, when the throttle valve 5' is opened during the starting mode, the fuel supply amount is increased as the opening degree $\theta_{TH}$ is increased.

The above correction is carried out for the following reason:

As described above, in the $T_{iCR}$ table, the basic value $T_{iCR}$ is set in accordance with a small amount of intake air, so that the air-fuel ratio of the mixture should assume a proper value so long as the driver does not step on the accelerator pedal at the start of the engine.

However, in actuality, the driver can start the engine in various manners. For example, if the driver tries to start the engine by stepping on the accelerator pedal, air is introduced also through the throttle valve 5' into the intake pipe 3, so that it becomes difficult to create sufficient vacuum within the intake pipe 3 and accordingly the air-fuel ratio is leaned, as the throttle valve opening $\theta_{TH}$ is increased.

More specifically, if the accelerator pedal is stepped on with the fuel supply amount maintained at a value determined based on the basic value $T_{iCR}$ from the $T_{iCR}$ table, the mixture is leaned relative to that required for the start of the engine, to thereby fail to obtain positive firing, resulting in degraded startability of the engine.

To overcome the above disadvantage, an increase in the fuel supply amount is needed in response to the throttle valve opening $\theta_{TH}$ when the accelerator pedal is stepped on at the start of the engine. Therefore, according to the present embodiment, a value of the fuel-increasing correction coefficient $K_{TiCR}$ dependent on the throttle valve opening $\theta_{TH}$ is searched from the $K_{TiCR}$ table to calculate the valve opening period $T_{OUT}$ based on the values $T_{iCR}$ and $K_{TiCR}$ by the use of the aforesaid equation (3), thereby correcting the fuel supply amount.

As described above, the startability of the engine can be enhanced by executing the control of the intake air amount alone or by executing both the control of the fuel supply amount and the control of the intake air amount.

Referring again to FIG. 3, if the answer to the question at the step 304 is Yes, that is, if it is determined that the starting mode has been continued for the predetermined period of time or the timer value $t_{ST}$, the valve opening command value $I_{ST}$ is set to the value $I_{ST1}$ on the $I_{ST1}$ line larger than the $I_{ST0}$ line, as shown in FIG. 5, which has been selected at the step 303, at a step 307, followed by executing the step 306 and then termination of the program. Thus, the intake air amount is increased through the control valve 10 after the starting mode lasts over the predetermined time period. That is, the value $I_{ST}$ is increased after the lapse of the predetermined period of time, though not shown in FIG. 12.

This dual-step control of the value $I_{ST}$ is based upon the following ground:

If the engine is started in a usual manner, it leaves the cranking state during execution of the steps 304, 305, and 306 in FIG. 3 and then the control is effected in after-starting mode, hereinafter described. However, there can be a case in which the starting mode lasts for an extraordinarily long time period. For instance, the starting switch 16 is kept closed for an unnecessarily long time period by the driver or through his judgement that ignition has not yet properly taken place.

In such cases, while the intake air amount is small, the fuel amount supplied to the engine is such that the ratio of the fuel amount to the intake air amount is still higher as the engine coolant temperature $T_W$ is lower, as best shown in FIG. 6, so that the air/fuel mixture is on the rich side relative to the stroichiometric ratio. As a result, the ignition plugs are liable to be wetted, which impedes firing from taking place in the engine cylinders.

To avoid such overrichment of the mixture, according to the invention, the intake air amount is increased by selecting the $I_{ST1}$ line. By virtue of this additional correction, the startability of the engine 1 is further enhanced even if the starting control that the intake air amount is decreased as the engine temperature is lower, is effected.

Further, the overrichment of the mixture takes place at an earlier time as the engine temperature is lower. Therefore, the $t_{ST}$ table in FIG. 4 has such a characteristic that a shorter tST value is selected as the engine temperature is lower, so that the increase of the intake air amount is effected at an earlier time as the temperature is lower.

After the control of the intake air amount and the fuel amount is effected at the start of the engine 1 in the above described manner, if the answer to the question at the step 20 in FIG. 2 becomes No, (for example when the starting switch 16 is opened as shown in FIG. 12), the control is carried out in after-starting mode at the step 22 ing FIG. 2.

According to the basic control subroutine at the step 22, the valve opening period $T_{OUT}$ of the fuel injection valves 11 is calculated by the following equation (4):

$$T_{OUT}=Ti\times K_{TW}\times K_1+K_2 \quad (4)$$

where $T_i$ represents a basic value of the valve opening period for the fuel injection valves 11, which is determined from a basic $T_i$ map in response to the absolute pressure $P_{BA}$ and the engine rotational speed $N_e$. $K_{TW}$ represents a fuel-increasing coefficient dependent upon engine load and the engine coolant temperature $T_W$, which is determined from a $K_{TW}$ table. $K_1$ and $K_2$ represent correction coefficients and correction variables, respectively, which are calculated depending on engine operating parameter signals, and are set, in response to engine operating conditions, to values required for achieving optimum fuel consumption, exhaust emission characteristics, etc.

The fuel supply control during the after-starting mode may be similar to a conventional one using the equation (4). On the other hand, the intake air amount control according to the invention includes the following control which is effected immediately after the completion of engine cranking until the idling feedback control is started.

Figure 8:
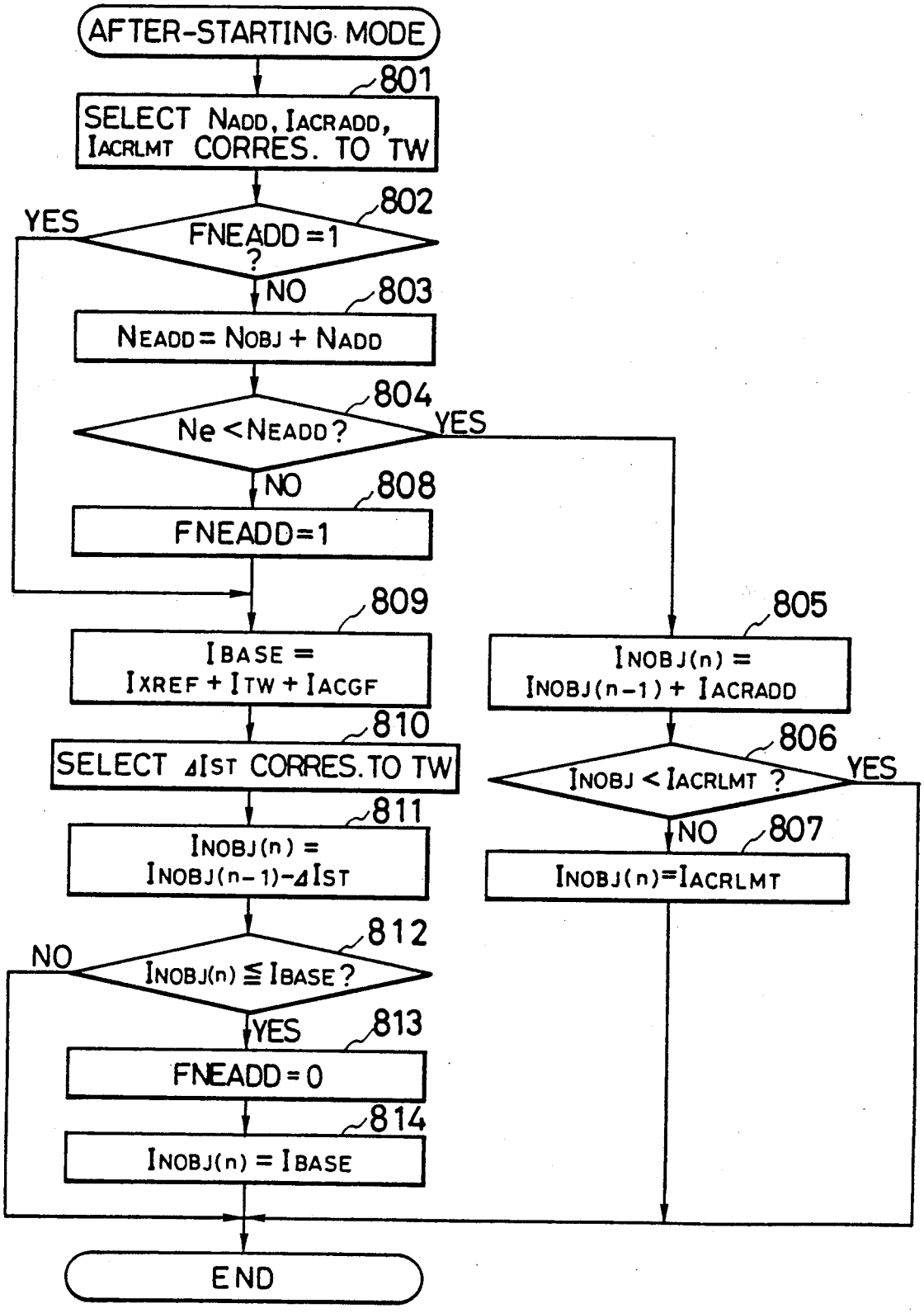
FIG. 8 is a flowchart showing a subroutine for calculating a control output or valve opening command value $I_{NOBJ}$ applied after the start of the engine.

FIG. 8 shows a subroutine for calculating the valve opening command value for the control valve 10, which forms part of the basic control subroutine in FIG. 2 and is executed within the CPU 7*b*.

At a step 801, selected in response to the engine coolant temperature $T_W$ are an additive value $N_{ADD}$ to be added to the desired value $N_{OBJ}$ of engine rotational speed at a step 803, hereinafter referred to, an incremental value $I_{ACRADD}$ (which is for increasing the intake air amount during the after-starting mode, i.e. for increasing the opening of the valve body 10*b* of the control valve 10) to be added to the valve opening command value $I_{NOBJ}$ at a step 805, hereinafter referred to, and an upper limit value $I_{ACRLMT}$ of the valve opening command value $I_{NOBJ}$ to be applied at a step 806, hereinafter referred to.

Figure 9:
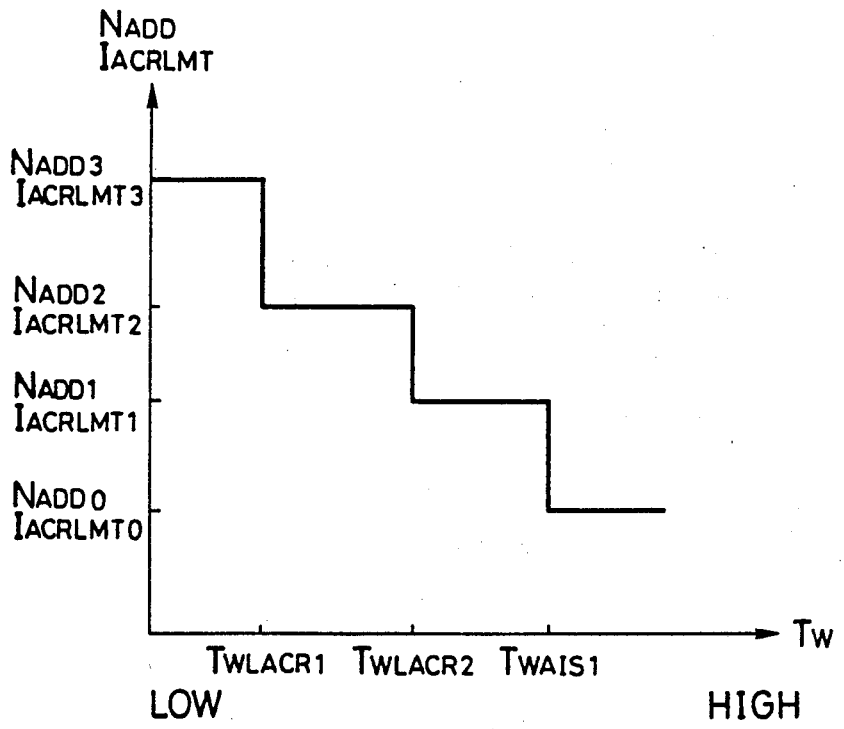
FIG. 9 is a graph showing an example of an $N_{ADD}$ table and an $I_{ACRLMT}$ table.
Figure 10:
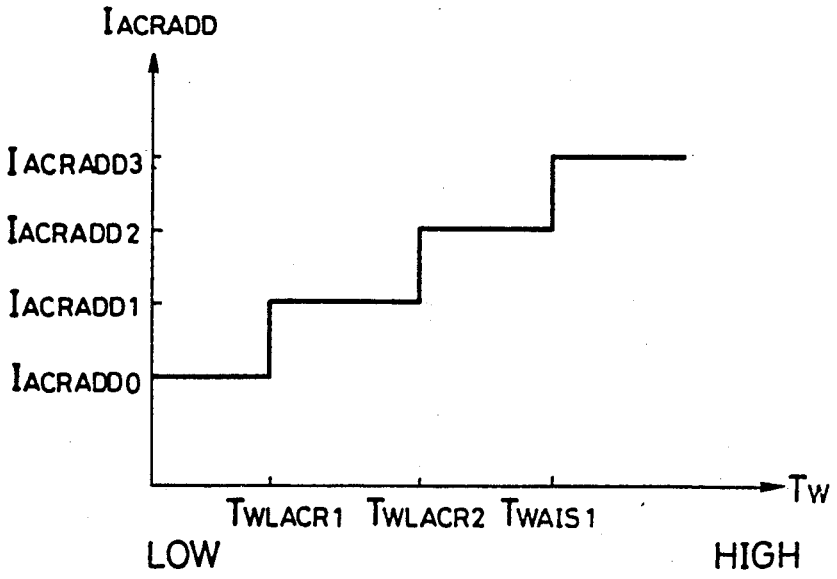
FIG. 10 is a graph showing an example of a $I_{ACRADD}$ table.

The values $N_{ADD}$, $I_{ACRADD}$, and $I_{ACRLMT}$ are set in respective tables as a function of the engine coolant temperature $T_W$, as shown in FIGS. 9 and 10. The tables of FIGS. 9 and 10 have common predetermined values $T_{WLACR1}$, $T_{WLACR2}$, and $T_{WAIS1}$ of the engine coolant temperature $T_W$. These predetermined values of the engine coolant temperature $T_W$ are also the same as those in FIG. 11.

In FIG. 9, examples of the $N_{ADD}$ table and the $I_{ACRLMT}$ table are shown, in which predetermined values $N_{ADD3}$–$N_{ADD0}$, $I_{ACRLMT3}$–$I_{ACRLMT0}$ of the values $N_{ADD}$ and $I_{ACRLMT}$ are set in such a manner that larger values $N_{ADD}$ and $I_{ACRLMT}$ are selected as the engine coolant temperature $T_W$ is lower. Similarly, in FIG. 10 showing an example of the $I_{ACRADD}$ table, predetermined values $I_{ACRADD3}$–$I_{ACRADD0}$ are set in such a manner that a smaller value $I_{ACRADD}$ is selected as the engine coolant temperature $T_W$ is lower.

After selecting values from the respective tables in response to the engine coolant temperature $T_W$ at the step 801, it is determined whether or not a flag FNEADD is equal to 1 at a step 802. The flag FNEADD is initially set to 0, so that the answer at the step 802 is No in the first loop of execution of the present program, followed by the program proceeding to a step 803. At the step 803, an upper limit value $N_{EADD}$ of the engine rotational speed to which the engine rotational speed should desirably be increased after the start of the engine 1 is calculated by adding the additive value $N_{ADD}$ to the desired value $N_{OBJ}$ by the following equation (5):

$$N_{EADD}=N_{OBJ}+N_{ADD} \quad (5)$$

Consequently, as indicated by the two-dot chain line in FIG. 12, the upper limit $N_{EADD}$ of the engine rotational speed is set to a value higher by the value $N_{ADD}$ than the desired value $N_{OBJ}$. The upper limit value $N_{EADD}$ is used as the reference value (predetermined value) when control of progressively increasing the valve opening, hereinafter described, is effected.

At the next step 804, it is determined whether or not the actual engine rotational speed Ne is lower than the upper limit value $N_{EADD}$. If the answer to the question is Yes, the program proceeds to a step 805 et seq., whereas if the answer is No, the program proceeds to a step 808 et seq.

Usually, the engine rotational speed Ne should be low immediately after the starting mode, as shown in FIG. 12. Therefore, in the first loop of the after-starting mode control, the program proceeds to the step 805, where the valve opening command value $I_{NOBJ}$ for the control valve 10 applied after the start of the engine 1 is calculated by the following equation (6):

$$I_{NOBJ(n)}=I_{NOBJ(n-1)}+I_{ACRADD} \quad (6)$$

That is, the last value $I_{NOBJ(n-1)}$ of the valve opening command value $I_{NOBJ}$ (in the first loop the value $I_{ST}$ set as the final value during the starting mode at the step 306 in FIG. 3) is added to by the value $I_{ACRADD}$ determined from the $I_{ACRADD}$ table.

At the step 805, the addition of the incremental value $I_{ACRADD}$ is repeated whenever the step 805 is effected.

Thus, the value $I_{NOBJ(n)}$ is gradually increased, as shown in FIG. 12, so that the valve opening of the valve body 10*b* of the control valve 10 is gradually increased.

The control of progressively increasing the valve opening is based upon the following ground:

In the starting control device, as described before, the valve opening of the control valve 10 is made smaller at the start of the engine 1 as the engine coolant temperature $T_W$ is lower. However, after the start of the engine 1 has been completed, it is desirable that the auxiliary air amount should be increased but to such an extent as not to degrade the driveability. This is because engine lubricating oil shows higher frictional resistance to the engine 1 as the engine coolant temperature $T_W$ is lower, due to its higher viscosity at a lower temperature. Therefore, the engine rotational speed should be increased as soon as possible so as to cope with the high frictional resistace of the oil and at the same time to achieve quick warming-up of the engine 1.

Therefore, the auxiliary air amount should be increased in order to increase the engine rotational speed. Especially in the invention, the air amount increase is more important since the air amount is controlled to a small value at the start of the engine. However, if the auxiliary air amount is abruptly or suddenly increased after the start of the engine, vacuum suddenly decreases to cause instability of the engine rotational speed. More specifically, if the air amount is abruptly increased instead of being progressively or slowly increased, it will result in degraded atomization of fuel, and hence the vacuum-responsive type ignition timing control device 17 is unable to advance the ignition timing. Further, generally the engine is not completely warmed up immediately after the start thereof so that the mixture does not burn well. Due to these facts, engine stalling can take place if the air amount is abruptly increased.

Therefore, after complete firing of the engine takes place, it is advantageous to gradually increase the valve opening of the control valve 10 to thereby increase engine torque so as to cope with the viscosity of the lubricating oil which becomes higher as the engine coolant temperature $T_W$ is lower, and to increase the frequency of combustion per unit time so as to quickly warm up the engine.

As described above, the auxiliary air amount is gradually increased after the start of the engine as the valve opening control value $I_{NOBJ(n)}$ is gradually increased so that the engine rotational speed is smoothly increased toward the upper limit value $N_{EADD}$ without causing engine stalling etc. after the start of the engine, to thereby enhance the stability of the engine rotational speed.

The setting of the upper limit value $N_{EADD}$ as a new desired value of engine rotatinal speed by adding the additive value $N_{ADD}$ to the desired engine rotational speed $N_{OBJ}$ at the step 803 is intended to warm up the engine more quickly as the engine coolant temperature $T_W$ is lower (that is, the value $N_{ADD}$ is set larger as the engine coolant temperature $T_W$ is lower). Further, the setting of the incremental value $I_{ACRADD}$ to smaller values as the engine coolant temperature $T_W$ is lower at the step 805 is intended to prevent engine stalling which can take place more easily by an abrupt increase in the auxiliary air amount as the engine coolant temperature $T_W$ is lower.

At a step 806, it is determined whether or not the control value $I_{NOBJ}$ obtained at the step 805 is smaller than the upper limit value $I_{ACRLMT}$. If the answer is Yes, the program skips over a step 807 to be terminated, whereas if the answer is No, that is, if $I_{NOBJ} \geqq I_{ACRLMT}$, the value $I_{ACRLMT}$ is set as the valve opening command value $I_{NOBJ}$ at the step 807, followed by termination of the program.

Thus, even when the actual engine rotational speed does not reach the upper limit value $N_{EADD}$, that is, even if the answer at the step 804 is Yes, the gradual increase of the value $I_{NOBJ}$ or the valve opening of the control valve 10 is stopped when the value $I_{NOBJ}$ reaches the upper limit value $I_{ACRLMT}$, and thereafter the value $I_{NOBJ}$ is maintained at the upper limit value $I_{ACRLMT}$, as indicated by the broken line in FIG. 12, so long as the answer at the step 806 is No. Therefore, during increase of the engine rotational speed $N_e$ after the start of the engine, an appropriate amount of intake air to the engine coolant temperature $T_W$ can be supplied into the intake pipe 3 while preventing supply of an excessive amount of intake air, to thereby prevent a sudden decrease in vacuum within the intake pipe 3 after the start of the control of progressively increasing the auxiliary air amount and hence enhance the stability of the engine rotational speed Ne.

If the answer to the question at the step 804 is No, that is, if $Ne \geqq N_{EADD}$, the flag $F_{MEADD}$ is set to 1 at a step 808, followed by the program proceeding to a step 809 et seq.

At the step 809 et seq., the valve opening command value $I_{NOBJ}$ is gradually decreased by the use of a predetermined decremental value to gradually decrease the valve opening of the control valve 10, as hereinafter described. The step 804 is for stopping the progressive increase control of the valve opening of the control valve 10 and starting the progressive decrease of same to decrease the engine rotational speed $N_e$. In actuality, the actual engine rotational speed Ne slightly exceeds the value $N_{EADD}$ when the progressive decrease control is started, as shown in FIG. 12, due to the progressive increase control executed immediately before.

At the step 809, a basic value $I_{BASE}$, which is applied as to an initial value of the valve opening command value $I_{CMD}$ at the start of feedback control to be executed when the engine rotational speed Ne is decreased into the the feedback control region by executing the progressive decrease control, is calculated by the following equation (7):

$$I_{BASE} = I_{XREF} + I_{TW} + I_{ACGF} \quad (7)$$

where $I_{XREF}$ represents a learned value obtained by learning values of $I_{NOBJ}$ applied during past idling feedback control of the valve opening of the control valve 10, $I_{TW}$ an engine coolant temperature-dependent correction value for compensating for the frictional resistance of sliding parts of the engine 1 which is increased when the engine coolant temperature $T_W$ is low, and $I_{ACGF}$ an electric load-dependent correction value set as a function of the magnitude of field current generated by an alternator, not shown, driven by the engine 1, or the like.

Figure 11:
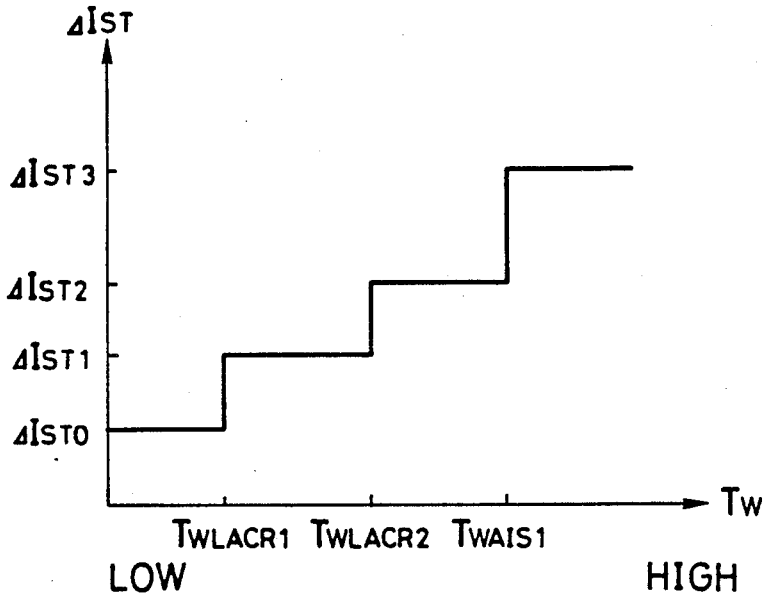
FIG. 11 is a graph showing an example of a $\Delta I_{ST}$ table.

At the next step 810, a decremental value $\Delta I_{ST}$ for the valve opening command value $I_{NOBJ}$ to be used at the next step 811 is selected from a $\Delta I_{ST}$ table shown in FIG. 11 in response to the engine coolant temperature $T_W$. As the value $\Delta I_{ST}$ set in the $\Delta I_{ST}$ table as a function of $T_W$, there are provided predetermined values $\Delta I_{ST0}$–$\Delta I_{ST3}$ which are set in such a manner that a smaller value $\Delta I_{ST}$ is selected as the engine coolant temperature $T_W$ is lower.

At the step 811, a value $I_{NOBJ(n)}$ of the valve opening command value $I_{NOBJ}$ in the present loop is calculated based on the value $I_{NOBJ(n-1)}$ in the last loop (which is the value $I_{NOBJ}$ calculated at the step 805 or the value $I_{NOBJ}$ ($=I_{ACRLMT}$) set at the step 807, by the use of the following equation (8):

$$I_{NOBJ(n)} = I_{NOBJ(n-1)} - \Delta I_{ST} \quad (8)$$

At the next step 812, it is determined whether or not the resulting value $I_{NOBJ}$ at the step 811 is smaller than the basic value $I_{BASE}$ obtained at the step 809. If the answer is No, the program is terminated by skipping over steps 813 and 814, hereinafter referred to.

In the next loop et seq., since the flag $F_{NEADD}$ was set to 1 at the step 808 in the last loop, the program skips over the steps 803, 804, and 808 to the step 809 et seq., and subtraction of the value $\Delta I_{ST}$ is carried out whenever the step 811 is effected.

Thus, the value $I_{NOBJ(n)}$ is gradually decreased as shown in FIG. 12. Even in the case that the value $I_{NOBJ}$ is maintained at the value $I_{ACRLMT}$ in the progressive increase control, the value $I_{NOBJ}$ is decreased after the engine rotational speed Ne has reached the upper limit value $N_{EADD}$.

The valve opening of the control valve 10 is progressively decreased in accordance with effecting the subtraction by the use of the valve opening command value $I_{NOBJ}$ to thereby progressively decrease the auxiliary air amount, resulting in a progressive decrease in the engine rotational speed Ne. Therefore, a smooth transition can be achieved from the after-starting control to the feedback control during idling of the engine 1, hereinafter described.

At the ste 812, the value $I_{NOBJ}$ is compared with the basic value $I_{BASE}$ calculated at the step 809, and if $I_{NOBJ} \leqq I_{BASE}$, that is, if the value $I_{NOBJ}$ is decreased to the initial value applied at the start of the feedback control, the flag $F_{NEADD}$ is set to 0 at the step 813, followed by the program proceeding to the step 814 where the value $I_{NOBJ}$ is set to the value $I_{BASE}$, followed by termination of the program.

The value $I_{BASE}$ set at the step 814 is applied as the initial value $I_{FB}$ at the start of the feedback control.

The resetting of the flag $F_{NEADD}$ enables the steps 803 et seq. to be executed at the next start of the engine 1. The execution of the subroutine shown in FIG. 8 is followed by execution of normal feedback control during idling of the engine 1 in accordance with a program, not shown.

The feedback control during idling is executed so as to maintain the actual engine rotational speed $N_e$ at the desired value by supplying the engine 1 with auxiliary air in an amount required to make zero the difference $\Delta N$ between the engine rotational speed Ne and the desired one.

In the embodiment FIG. 8 described above, the after-starting control for controlling the supplementary air amount to be combined with the starting control in which the valve opening of the control valve 10 is set to a smaller value at the start of the engine 1 as the engine coolant temperature $T_W$ is lower, executes both of the control of progressively increasing the valve opening of the control valve 10 after the start of the engine 1 and the control of progressively decreasing same. However, the invention is not limited to this, but may be embodied by only one of them.

Further, although in the embodiment described above, the control valve 10 is a proportional solenoid type which is controlled by varying the magnitude of driving current, alternatively the intake air amount may be controlled by duty-ratio control of the opening period of an on-off type control valve.

What is claimed is:

1. In a system for controlling the operation of an internal combustion engine having an intake passage, including temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, and valve actuator means responsive to an output from said valve opening determining means for controlling said control valve means, the improvement including starting period detecting means for detecting whether or not a starting state of said engine has lasted over a predetermined period of time and intake air amount correcting means for correcting the amount of intake air to a larger value after said predetermined period of time has elapsed, said predetermined period of time being set to a shorter value as the temperature of said engine is lower, wherein said valve opening determining means sets the opening of said control valve at the start of said engine to a value such that the amount of intake air is smaller as the temperature of said engine sensed by said temperature sensor means is lower.

2. A system for controlling the operation of an internal combustion engine having an intake passage, including temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, said valve opening determining means setting the opening of said control valve at the start of said engine to a value such that the amount of intake air is smaller as the temperature of said engine sensed by said temperature sensor means is lower, valve actuator means responsive to an output from said valve opening determining means for controlling said control valve means, a throttle valve arranged in said intake passage, the system including fuel amount determining means responsive to the output from said temperature sensor means for determining an amount of fuel to be supplied to said engine at the start of same, fuel supply means for supplying said engine with the amount of fuel determined by said fuel amount determining means, second valve opening sensor means for sensing the opening of said throttle valve, correction value determining means responsive to an output from said second valve opening sensor means for determining a correction value for the amount of fuel, said correction value determining means determining said correction value so as to increase the amount of fuel at a larger rate as the opening of said throttle valve is larger, correcting means for correcting the amount of fuel based on the determined correction value, starting period detecting means for detecting whether or not a starting state of said engine has lasted over a predetermined period of time, and intake air amount correcting means for correcting the amount of intake air to a larger value after said predetermined period of time has elapsed, said predetermined period of time being set to a shorter value as the temperature of said engine is lower.

3. In a system for controlling the operation of an internal combustion engine having an intake passage, including temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, and valve actuator means responsive to an output from said valve opening determining means for controlling said control valve means, the improvement wherein said valve opening determining means sets the opening of said control valve at the start of said engine to a value such that the amount of intake air is smaller as the temperature of said engine sensed by said temperature sensor means is lower, and wherein said system includes third valve opening determining means responsive to the output from said temperature sensor means for determining the opening of said control valve after the start of said control valve after the start of said engine, upper limit value setting means responsive to the output from said temperature sensor means for setting an upper limit value of the opening of said control valve after the start of said engine, and valve opening progressive increase means for progressively increasing the opening of said control valve determined by said third valve opening determining means to the set upper limit value.

4. A system for controlling the operation of an internal combustion engine having an intake passage, including temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, said valve opening determining means setting the opening of said control valve at the start of said engine to a value such that the amount of intake air is smaller as the temperature of said engine sensed by said temperature sensor means is lower, valve actuator means responsive to an output from said valve opening determining means for controlling said control valve means, a throttle valve arranged in said intake passage, the system including fuel amount determining means responsive to the output form said temperature sensor means for determining an amount of fuel to be supplied to said engine at the start of same, fuel supply means for supplying said engine with the amount of fuel determined by said fuel amount determining means, second valve opening sensor means for sensing the opening of said throttle valve, correction value determining means responsive to an output from said second valve opening sensor means for determining a correction value for the amount of fuel, said correction value determining means determining said correction value so as to increase the amount of fuel at a larger rate as the opening of said throttle valve is larger, and correcting means for correcting the amount of fuel based on the determined correction value, third valve opening determining means responsive to the output from said temperature sensor means for determining the opening of said control valve after the start of said engine, upper limit value setting means responsive to the output from said temperature sensor means for setting an upper limit value of the opening of said control valve after the start of said engine, and valve opening progressive increase means for progressively increasing the opening of said control valve determined by said third valve opening determining means to the set upper limit value.

5. A system as claimed in claim 3 or 4, wherein said third valve opening determining means sets the opening of said control valve to a smaller value as the temperature of said engine is lower.

6. A system as claimed in claim 3 or 4, wherein said upper limit value of the opening of said control valve is set to a larger value as the temperature of said engine is lower.

7. A system as claimed in claim 3 or 4, wherein said valve opening progressive increase means progressively increases the opening of said control valve at a smaller rate as the temperature of said engine is lower.

8. In a system for controlling the operation of an internal combustion engine having an intake passage, including temperature sensor means for sensing a temperature of said engine, control valve means for controlling an amount of intake air supplied into said intake passage of said engine, valve opening determining means responsive to an output from said temperature sensor means for determining the opening of said control valve means at the start of said, engine, and valve actuator means responsive to an output from said valve opening determining means for controlling said control valve means, the improvement wherein said valve opening determining means sets the opening of said control valve at the start of said engine to a value such that the amount of intake air is smaller as the temperature of said engine sensed by said temperature sensor means is lower, and wherein said system includes engine rotational speed setting means responsive to the output from said temperature sensor means for setting a predetermined value of the rotational speed of said engine, third valve opening determining means responsive to the output from said temperature sensor means for determining the opening of said control valve after the start of said engine, and valve opening progressive decrease means for progressively decreasing the opening of said control valve after the rotational speed of said engine reaches said predetermined value.

9. A system for controlling the operation of an internal combustion engine having an intake passage, including temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, said value opening determining means setting the opening of said control valve at the start of said engine to a value such that the amount of intake air is smaller as the temperature of said engine sensed by said temperature sensor means is lower, valve actuator means responsible to an output from said valve opening determining means for controlling said control valve means, a throttle valve arranged in said intake passage, the system including fuel amount determining means responsive to the output from said temperature sensor means for determining an amount of fuel to be supplied to said engine at the start of same, fuel supply means for supplying said engine with the amount of fuel determined by said fuel amount determining means, second valve opening sensor means for sensing the opening of said throttle valve, correction value determining means responsive to an output from said second valve opening sensor means for determining a correction value for the amount of fuel, said correction value determining means determining said correction value so as to increase the amount of fuel at a larger rate as the opening of said throttle valve is larger, correcting means for correcting the amount of fuel based on the determined correction value, engine rotational speed setting means responsive to the output from said temperature sensor means for setting a predetermined value of the rotational speed of said engine, third valve opening determining means responsive to the output from said temperature sensor means for determining the opening of said control valve after the start of said engine, and valve opening progressive decrease means for progressively decreasing the opening of said control valve after the rotational speed of said engine reaches said predetermined value.

10. A system as claimed in claim 8 or 9, wherein said engine rotational speed setting means sets said predetermined value to a larger value as the temperature of said engine is lower.

11. A system as claimed in claim 8 or 9, wherein said third valve opening determining means sets the opening of said control valve to a smaller value as the temperature of said engine is lower.

12. A system as claimed in claim 8 or 9, wherein said valve opening progressive decrease means progressively decreases the opening of said control valve at a smaller rate as the temperature of said engine is lower.

13. In a system for controlling the operation of an internal combustion engine having an intake passage, including temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, and valve actuator means responsive to an output from said valve opening determining means for controlling said control valve means, the improvement wherein said valve opening determining means sets the opening of said control valve at the start of said engine to a value such that the amount of intake air is smaller as the temperature of said engine sensed by said temperature sensor means is lower, and wherein said system includes engine rotational speed setting means responsive to the output from said temperature sensor means for setting a predetermined value of the rotational speed of said engine, third valve opening determining means responsive to the output from said temperature sensor means for determining the opening of said control valve after the start of said engine, valve opening progressive increase means for progressively increasing the opening of said control valve determined by said third valve opening determining means, and progressive increase stop means for stopping the progressive increase of the opening of said control valve effected by said valve opening progressive increase means when the rotational speed of said engine reaches said predetermined value.

14. A system for controlling the operation of an internal combustion engine having an intake passage, comprising:

temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, said valve opening determining means setting the opening of said control valve at the start of said engine to a value such that the amount of intake air is smaller as the temperature of said engine sensed by said temperature sensor means is lower, valve actuator means responsive to an output from said valve opening determining means for controlling said control valve means, a throttle valve arranged in said intake passage, fuel amount determining means responsive to the output from said temperature sensor means for determining an amount of fuel to be supplied to said engine at the start of same, fuel supply means for supplying said engine with the amount of fuel determined by said fuel amount determining means, second valve opening sensor means for sensing the opening of said throttle valve, correction value determining means responsive to an output from said second valve opening sensor means for determining a correction value for the amount of fuel, said correction value determining means determining said correction value so as to increase the amount of fuel at a larger rate as the opening of said throttle valve is larger, correcting means for correcting the amount of fuel based on the determined correction value, engine rotational speed setting means responsive to the output from said temperature sensor means for setting a predetermined value of the rotational speed of said engine, third valve opening determining means responsive to the output from said temperature sensor means for determining the opening of said control valve after the start of said engine, valve opening progressive increase means for progressively increasing the opening of said control valve determined by said third valve opening determining means, and progressive increase stop means for stopping the progressive increase of the opening of said control valve effected by said valve opening progressive increase means when the rotational speed of said engine reaches said predetermined value.

15. A system as claimed in claim 13 or 14, wherein said engine rotational speed setting means sets said predetermined value to a larger value as the temperature of said engine is lower.

16. A system as claimed in claim 13 or 14, wherein said third valve opening determining means sets the opening of said control valve to a smaller value as the temperature of said engine is lower.

17. A system as claimed in claim 13 or 14, including valve opening progressive decrease means for progressively decreasing the opening of said control valve after said progressive increase stop means stops the progressive increase of the opening of said control valve effected by said valve opening progressive increase means.

18. A system as claimed in claim 13 or 14, wherein said valve opening progressive increase means progressively increases the opening of said control valve at a smaller rate as the temperature of said engine is lower.

19. A system as claimed in claim 13 or 14, wherein said valve opening progressive decrease means progressively decreases the opening of said control valve at a smaller rate as the temperature of said engine is lower.

20. In a system for controlling the operation of an internal combustion engine having an intake passage, including temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, and valve actuator means responsive to an output from said valve opening determining means for controlling said control valve means, the improvement wherein said valve opening determining means sets the opening of said control valve at the start of said engine to a value such that the amount of intake air is smaller as the temperature of said engine sensed by said temperature sensor means is lower, and wherein said system includes third valve opening determining means responsive to the output from said temperature sensor means for determining the opening of said control valve after the start of said engine, upper limit value setting means responsive to the output from said temperature sensor means for setting an upper limit value of the opening of said control valve after the start of said engine, engine rotational speed setting means responsive to the output from said temperature sensor means for setting a predetermined value of the engine rotational speed, valve opening progressive increase means for progressively increasing the valve opening determined by said third valve opening determining means at a rate depending upon the temperature of said engine until the opening of said control valve reaches said upper limit value set by said upper limit value setting means, and valve opening progressive decrease means for progressively decreasing the opening of said control valve after the engine rotational speed reaches said predetermined value.

21. A system for controlling the operation of an internal combustion engine having an intake passage, comprising:

temperature sensor means for sensing a temperature of said engine, control valve means for controlling an amount of intake air supplied into said intake passage of said engine, valve opening determining means responsive to an output from said temperature sensor means for determining the opening of said control valve means at the start of said engine, said valve opening determining means setting the opening of said control valve at the start of said engine to a value such that the amount of intake air is smaller as the temperature of said engine sensed by said temperature sensor means is lower, valve actuator means responsive to an output from said valve opening determining means for controlling said control valve means, a throttle valve arranged in said intake passage, fuel amount determining means responsive to the output from said temperature sensor means for determining an amount of fuel to be supplied to said engine at the start of same, fuel supply means for supplying said engine with the amount of fuel determined by said fuel amount determining means, second valve opening sensor means for sensing the opening of said throttle valve, correction value determining means responsive to an output from said second valve opening sensor means for determining a correction value for the amount of fuel, said correction value determining means determining said correction value so as to increase the amount of fuel at a larger rate as the opening of said throttle valve is larger, correcting means for correcting the amount of fuel based on the determined correction value, third valve opening determining means responsive to the output from said temperature sensor means for determining the opening of said control valve after the start of said engine, upper limit value setting means responsive to the output from said temperature sensor means for setting an upper limit value of the opening of said control valve after the start of said engine, engine rotational speed setting means responsive to the output from said temperature sensor means for setting a predetermined value of the engine rotational speed, valve opening progressive increase means for progressively increasing the valve opening determined by said third valve opening determining means at a rate depending upon the temperature of said engine until the opening of said control valve reaches said upper limit value set by said upper limit value setting means, and valve opening progressive decrease means for progressively decreasing the opening of said control valve after the engine rotational speed reaches said predetermined value.

22. A system as claimed in claim 20 or 21, wherein said third valve opening determining means sets the opening of said control valve to a smaller value as the engine temperature is lower.

23. A system as claimed in claim 20 or 21, wherein said upper limit value of the opening of said control valve is set to a larger value as the engine temperature is lower.

24. A system as claimed in claim 20 or 21, wherein said engine rotational speed setting means sets said predetermined value to a larger value as the temperature of said engine is lower.

25. A system as claimed in claim 20 or 21, wherein said valve opening progressive increase means progressively increases the opening of said control valve at a smaller rate as the temperature of said engine is lower.

26. A system as claimed in claim 20 or 21, wherein said valve opening progressive decrease means progressively decreases the opening of said control valve at a smaller rate as the temperature of said engine is lower.

* * * * *